US008622122B2

(12) United States Patent
Demers et al.

(10) Patent No.: US 8,622,122 B2
(45) Date of Patent: Jan. 7, 2014

(54) ROD REEL AND METHOD OF REPAIRING A ROD STRING

(76) Inventors: Patrick Demers, Elk Point (CA); John Charlton, Elk Point (CA)

( * ) Notice: Subject to any disclaimer, the term of this patent is extended or adjusted under 35 U.S.C. 154(b) by 208 days.

(21) Appl. No.: 12/965,337

(22) Filed: Dec. 10, 2010

(65) Prior Publication Data

US 2011/0139287 A1 Jun. 16, 2011

Related U.S. Application Data

(60) Provisional application No. 61/285,338, filed on Dec. 10, 2009.

(51) Int. Cl.
*E21B 17/00* (2006.01)

(52) U.S. Cl.
USPC ..... 166/77.2; 166/277; 166/380; 166/77.51

(58) Field of Classification Search
USPC ..... 166/380, 77.2, 77.51, 277; 242/388, 242/388.6, 604; 138/97, 106
See application file for complete search history.

(56) References Cited

U.S. PATENT DOCUMENTS

| | | | | |
|---|---|---|---|---|
| 2,714,456 | A | 8/1955 | Manaugh | |
| 2,895,691 | A | 7/1959 | Toler | |
| 3,222,704 | A | 12/1965 | Ciaccio | |
| 3,266,763 | A * | 8/1966 | Kutz | 248/89 |
| 3,504,866 | A | 4/1970 | Palynchuk et al. | |
| 3,559,905 | A | 2/1971 | Palynchuk | |
| 3,673,627 | A * | 7/1972 | Caperton | 15/104.33 |
| 5,937,943 | A | 8/1999 | Butler | |
| 6,253,849 | B1 | 7/2001 | Newman | |
| 6,454,014 | B2 | 9/2002 | Coats et al. | |
| 2006/0243453 | A1 * | 11/2006 | McKee | 166/380 |

* cited by examiner

*Primary Examiner* — David Bagnell
*Assistant Examiner* — Taras P Bemko
(74) *Attorney, Agent, or Firm* — Davis & Bujold, PLLC; Michael J. Bujold

(57) ABSTRACT

A rod reel includes a reel body having a central axis, a first rod receiving channel and a second rod receiving channel. The first and second rod receiving channels are centered about the central axis. The second rod receiving channel is adjacent to the first rod receiving channel. The rod reel may be used to repair a rod string by loading a supplemental rod string in one of the pockets, loading the rod string into another of the pockets, cutting the rod string, and attaching a desired length of the supplemental rod string to the cut in the rod string.

15 Claims, 5 Drawing Sheets

ROD REEL AND METHOD OF REPAIRING A ROD STRING

FIELD

This relates to a rod reel, and a method of using the rod reel to repair a rod string.

BACKGROUND

U.S. Pat. No. 3,559,905 (Palynchuk) entitled "Method and apparatus for running and pulling a continuous metal member into and out of a well" describes equipment used to transport, inject and remove a rod string.

SUMMARY

According to an aspect, there is provided a rod reel, comprising a reel body comprising a central axis, a first rod receiving channel and a second rod receiving channel each centered about the central axis, the second rod receiving channel being adjacent to the first rod receiving channel.

According to other aspects, the first and second rod receiving channels may be angled toward the central axis. The second rod receiving channel may be spaced inward on the reel body relative to the first rod receiving channel. A third rod receiving channel may be adjacent to the second rod receiving channel.

According to another aspect, there is provided a method of repairing a rod string deployable in a well. The method comprises providing a rod reel as described above. A supplemental rod string is loaded in one of the pockets. The rod string is loaded into another of the pockets. The rod string is cut, and a desired length of the supplemental rod string is attached to the cut in the rod string.

According to other aspects, cutting the rod string may comprise removing a damaged section of the rod string. The desired length of the supplemental rod string may be substantially the same length as the damaged section of the rod string. The damaged section of the rod string may be one of a top section of the rod string, a bottom section of the rod string, or an intermediate section of the rod string. The method may further comprise the step of removing an additional damaged section of the rod string and attaching an additional desired length to the cut in the rod string. The method may further comprise the step of loading the damaged section of the rod string into one of the pockets for removal from a well site.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
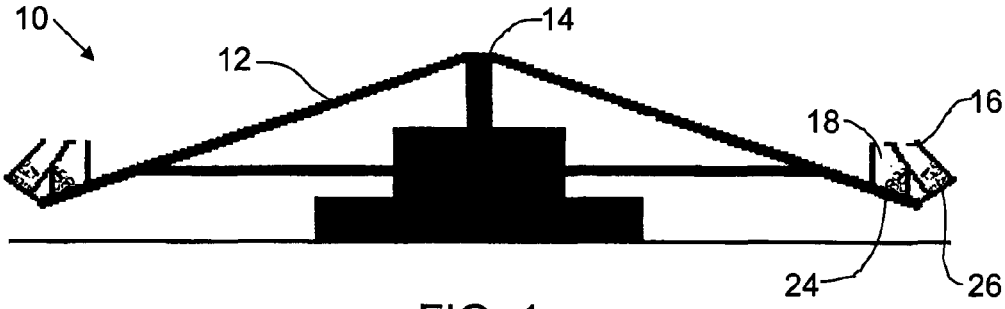
FIG. 1 is a side elevation view in section of the rod reel.

A rod reel generally identified by reference numeral 10, will now be described with reference to FIG. 1 through 5. A method of servicing a rod string deployed in a well will then be described with reference to FIG. 6.

Figure 3:
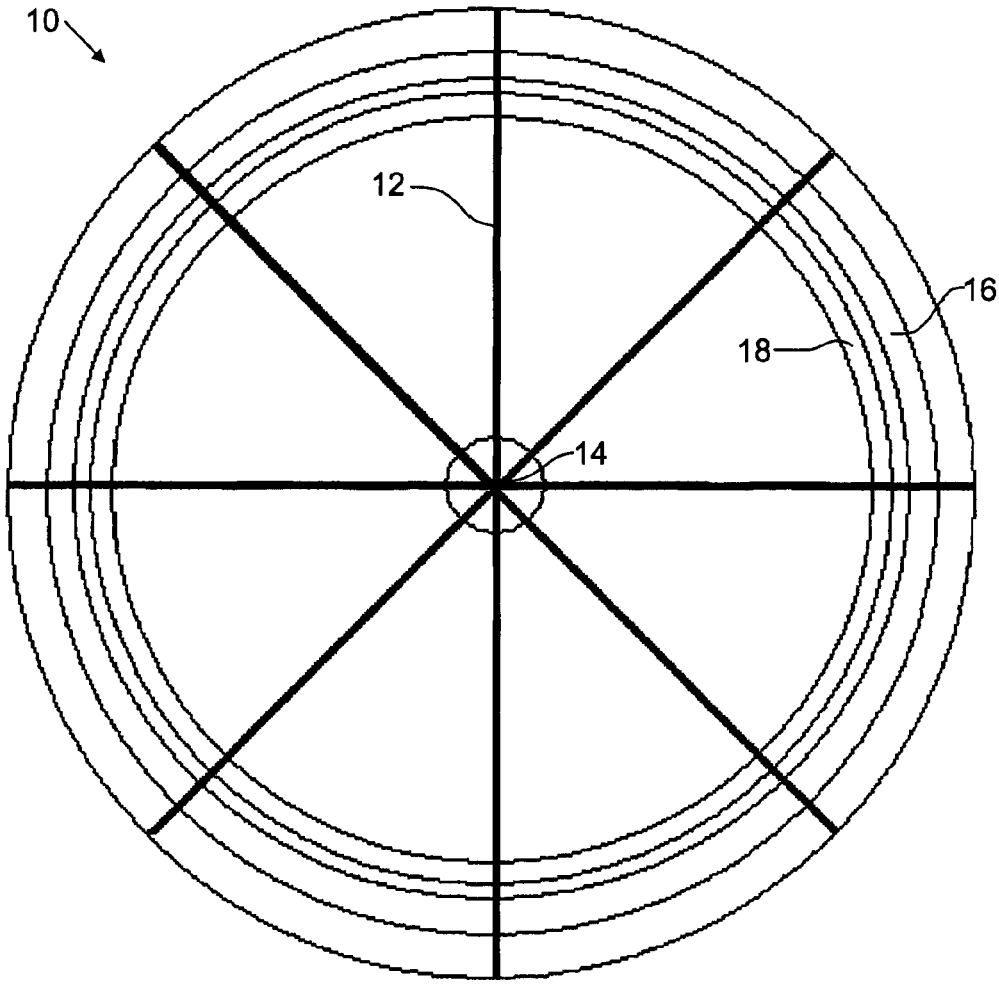
FIG. 3 is a top view of a rod reel.
Figure 4:
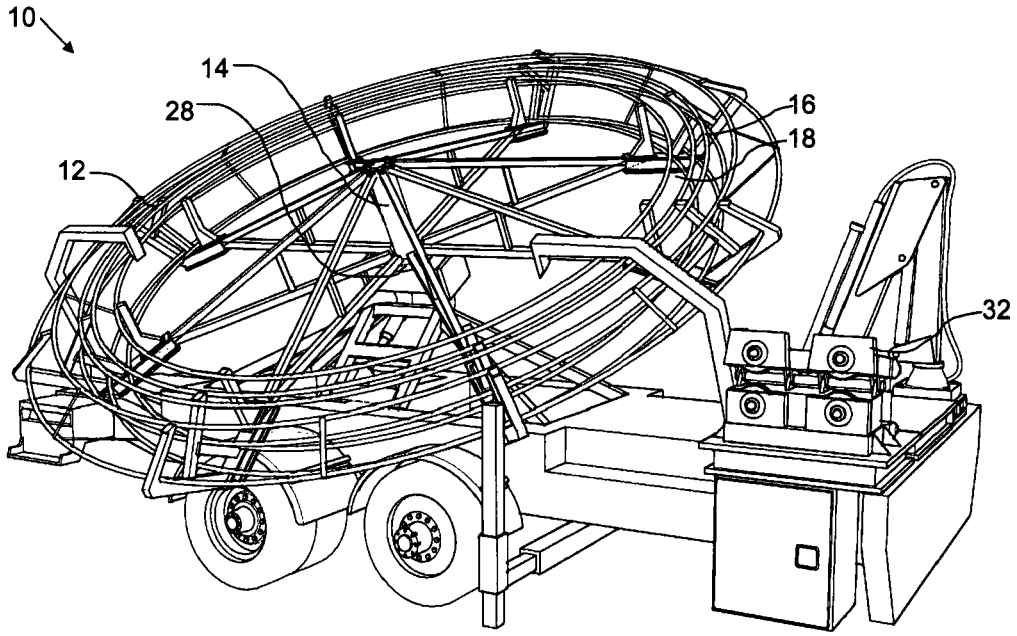
FIG. 4 is a perspective view of the rod reel.
Figure 5:
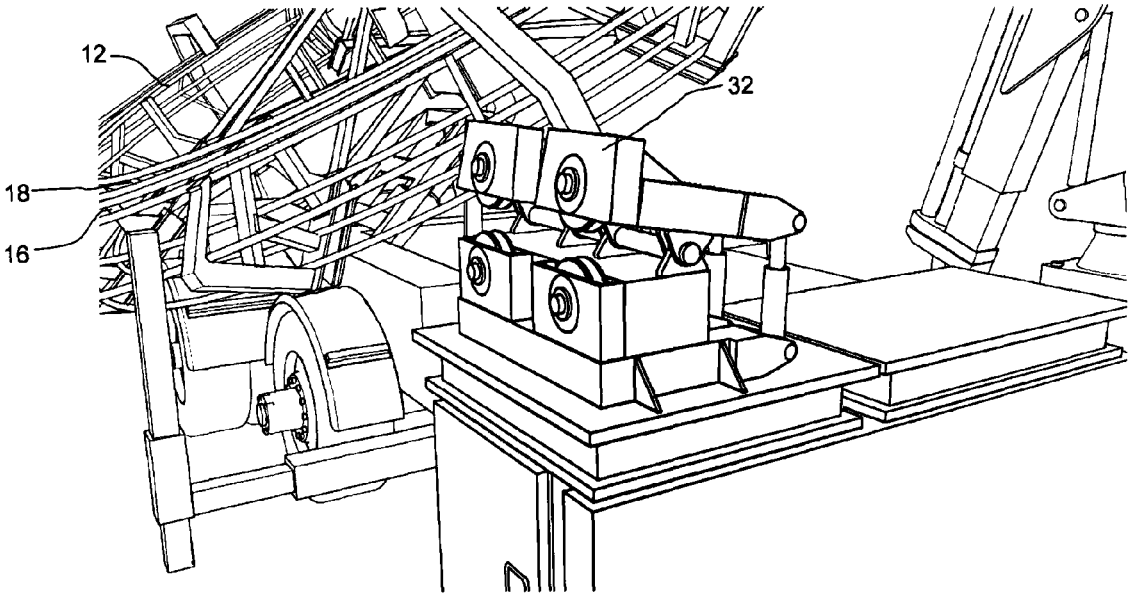
FIG. 5 is a detailed perspective view of the rod reel with a pinch roller.

Referring to FIG. 1, rod reel 10 is a multi-pocket transfer reel, and has a reel body 12 comprising a linear central axis 14, a first rod receiving channel 16 and a second rod receiving channel 18. Referring to FIG. 3, first and second rod receiving channels 16 and 18 are substantially ring shaped and centered on central axis 14. Second rod receiving channel 18 is adjacent to first rod receiving channel 16. When mounted on a truck or trailer, axis 14 sits on a spindle 28 that allows rod reel 10 to turn. The embodiment shown in FIGS. 1 and 2 may rest on the ground. Referring to FIG. 4, when mounted on a rod transfer truck or trailer, it may be raised or lowered to a desired angle using known lifting mechanisms.

Figure 2:
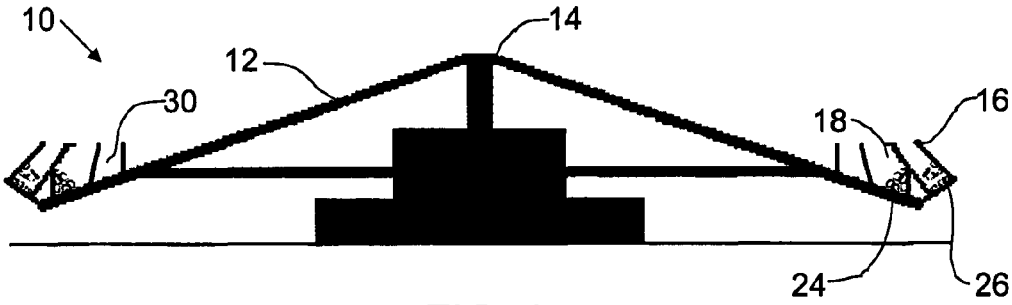
FIG. 2 is a side elevation view of an alternative rod reel with stored endless rod.

Referring to FIG. 2, there may be a third channel 30 adjacent to first and second channels 18 as well. More than three channels may also be present. This may be desired if multiple sizes of rod string are to be transferred.

Referring to FIG. 1, channels 16 and 18 have been designed with safety and convenience in mind, such as both channels 16 and 18 being angled toward linear central axis 14 and first rod channel 16 being angled relative to the second rod receiving channel 18, in order to prevent the loaded rod 24 and 26 from coming out during or after loading.

In the examples discussed below, first channel 16 is used for used rod 26, while replacement, or new rod 24, is loaded into second channel 18. This arrangement has been found to be more convenient in some circumstances, although it will be understood that either channel may store either type of rod.

Figure 6:
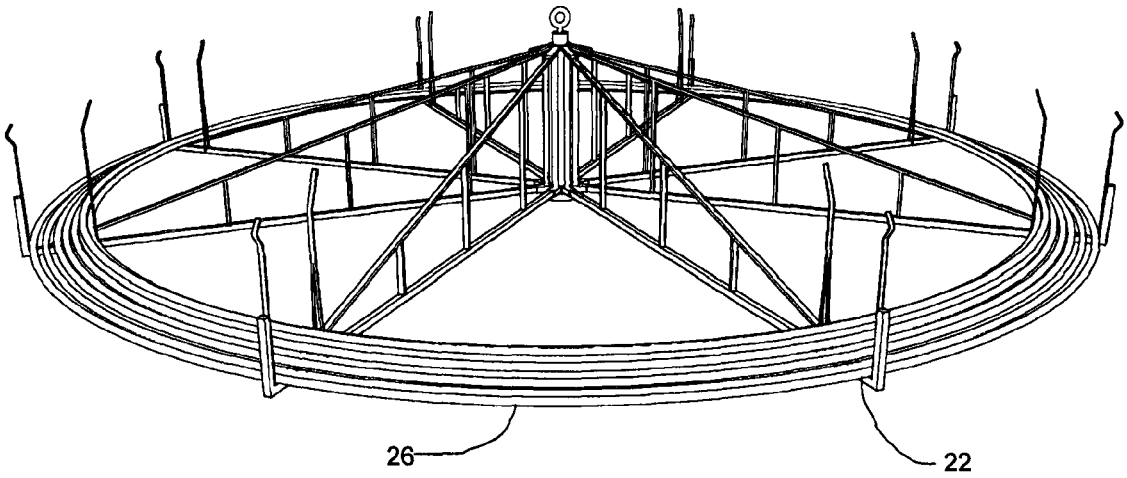
FIG. 6 is a perspective view of a field service reel with stored endless rod.

There will now be discussed a method of employing rod reel 10 to repair a rod string that is used in a wellbore. Referring to FIG. 4, rod reel 10 is preferably loaded onto a rod transfer truck or trailer, as shown. A service reel 22 shown in FIG. 6 is also used to handle the rod 26. Referring to FIG. 1, rod reel 10 is shown as holding new rod 24 and used rod 26. While not shown, a picker or rod guide, a rod shear, and a winch are also commonly used when handling rod strings. Referring to FIG. 4, a pinch roller 32 is carried along with rod reel 10. The rod reel may be used to carry a replacement section of rod that is inserted into the existing rod string, or it may be used to carry an entire replacement rod string.

Rod reel 10 can be employed to repair rod at the bottom of the rod string, in the middle of the rod string, or at the top of the rod string. A general method will be discussed below, but variations will be apparent to those skilled in the art. Certain differences will become apparent from the discussion of each below.

Bottom of the Rod String Repair

Referring to FIG. 4, at the rod yard, a new pin end may be welded on and the ordered amount of new endless rod 24 is loaded into, for example, the outside pocket 16 of transfer reel 12. The pin end may also be welded on location. Using a winch the tail end of the new endless rod 24 is brought into the pocket where it is secured. Rod reel 10 is then taken to the location for rod repair. The rod transfer truck or trailer is backed to the service reel 22, shown in FIG. 6, and the used endless rod 26 is threaded through the picker/rod guide, then through the pinch roller 32. Using the pinch roller 32 the rod end is pushed into and secured inside the rod reel 10 inside pocket 18. Using pinch roller 32, the worn endless rod 26 is measured and spooled on to rod reel 10. Using a rod shear, the used endless rod 26 is then cut. Using the winch the rod tail end is brought inside the pocket and secured in place. Again using the winch the tail end of the new endless rod 24 is removed from outside pocket 16 of rod reel 10. The new endless rod 24 is then strung through the pinch roller 32 and the picker/rod guide. Using pinch roller 32 the new endless rod 24 is fed to the welder. The welder can then weld the new endless rod 24 to the used endless rod that is on the service reel 22, shown in FIG. 6. After welding is completed the rod transfer truck or trailer is backed to the service reel 22. Using pinch roller 32, the new endless rod 24 is spooled onto the service reel 22.

Middle of the Rod String Repair

At the rod yard, the ordered amount of new endless rod 24 is loaded into the rod reel 10 inside pocket 18. Using a winch the tail end of the new endless rod 24 is brought into the pocket and secured. The rod reel 10 is then taken to the location for rod repair. The rod transfer truck or trailer is backed to the service reel 22 shown in FIG. 6, the used endless rod 26 is threaded through picker/rod guide and then through the pinch roller 32. Using the pinch roller 32, the rod end is pushed into and secured inside the transfer reel 12 outside pocket 16. Using pinch roller 32, the used endless rod 26 is spooled until the worn rod is found. Using a rod shear, the worn endless rod is measured and cut out. Using the winch, the rod tail end is brought inside the pocket and secured. Again using the winch, the tail end of the new endless rod 24 is removed from inside pocket 18 of rod reel 10. The new endless rod 24 is strung through the pinch roller 32 and the picker/rod guide. The pinch roller 32 is then used to feed the new endless rod 24 to the welder. The welder can then weld the new endless rod 24 to the used endless rod that is on the service reel 22, shown in FIG. 6. After welding is completed, the new endless rod 24 is spooled onto service reel 22. Using the winch, the tail end of the used rod 26 is removed from out of outside pocket 16 of rod reel 10. The used endless rod 26 is then strung through the pinch roller 32 and the picker/rod guide. Using pinch roller 32 the used endless rod 26 is fed to the welder. The welder can then weld the used endless rod 26 to the new endless rod that is on the service reel 22. After welding is completed the used endless rod 26 is spooled onto service reel 22 using pinch roller 32.

Top of the Rod String Repair

At the rod yard, the ordered amount of new endless rod 24 is loaded into inside pocket 18 of rod reel 10 with a welded pin on the end. The pin may also be welded on location. Using a winch, the pin end of the new endless rod 24 is brought into the pocket and secured. The rod reel 10 is then taken to the location for rod repair. The rod transfer truck or trailer is backed to the service reel 22 shown in FIG. 6 and the used endless rod 26 is threaded through a picker/rod guide, then through the pinch roller 32. Using the pinch roller 32, the rod end is pushed into and secured inside outside pocket 16 of rod reel 10. Using pinch roller 32, the used endless rod 26 is spooled on until the worn rod is found. Using a rod shear, the worn endless rod is measured and cut out. Using the winch, the rod tail end is brought inside the pocket and secured. Again using the, winch, the pin end of the new endless rod 24 is removed from inside pocket 18 of rod reel 10. The new endless rod 24 is strung through the pinch roller 32 and the picker/rod guide. Pinch roller 32 is then used to spool off the new endless rod 24 onto the service reel 22, shown in FIG. 6. Using the winch, the rod tail end is brought out from the outside pocket 16 then feed the used endless rod 26, through the pinch roller 32 and the picker/rod guide, and then to the welder. The welder can then weld the used endless rod 26 to the new endless rod 24 that is on the service reel 22. After welding is completed, the used endless rod 26 is spooled onto service reel 22 using pinch roller 32.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A rod reel, comprising:

a reel body comprising a linear central axis, a first rod receiving channel and a second rod receiving channel each centered about the central axis, the first rod receiving channel being completely separate and distinct from the second rod receiving channel, the second rod receiving channel being concentrically nested within the first rod receiving channel and the second rod receiving channel being angled relative to the central axis and relative to the first rod receiving channel.

2. The rod reel of claim 1, wherein the first and second rod receiving channels are angled toward the central axis.

3. The rod reel of claim 1, wherein the second rod receiving channel is spaced inward on the reel body relative to the first rod receiving channel.

4. The rod reel of claim 1, comprising a third rod receiving channel adjacent to the second rod receiving channel.

5. The rod reel of claim 1, in combination with a rod string feed mechanism.

6. A method of repairing a rod string deployable in a well, the rod string having at least one damaged section, the method comprising:

providing a rod reel comprising:

a reel body comprising a central axis and a first rod receiving channel and a second rod receiving channel each centered about the central axis, the second rod receiving channel being nested within an inner perimeter of the first rod receiving channel;

loading a replacement rod string in one of the channels;

transporting the replacement rod string to the well;

removing the rod string from the well and loading at least the damaged section of the rod string into another of the channels; and unloading the replacement rod string.

7. The method of claim 6, wherein the first and second rod receiving channels of the rod reel are angled toward the central axis and transporting the replacement rod string to the well comprises transporting the reel with at least one empty pocket.

8. The method of claim 6, wherein the second rod receiving channel of the rod reel is spaced inward on the reel body relative to the first rod receiving channel.

9. The method of claim 6, comprising a third rod receiving channel adjacent to the second rod receiving channel.

10. The method of claim 6, wherein unloading the replacement rod string comprises cutting the rod string and attaching a desired length of the replacement rod string to the cut in the rod string.

11. The method of claim 10, wherein cutting the rod string comprises removing a damaged section of the rod string.

12. The method of claim 11, wherein the desired length of the replacement rod string is substantially the same length as the damaged section of the rod string.

13. The method of claim 11, wherein the damaged section of the rod string is one of a top section of the rod string, a bottom section of the rod string, or an intermediate section of the rod string.

14. The method of claim 11, comprising the step of removing an additional damaged section of the rod string and attaching an additional desired length to the cut in the rod string.

15. The method of claim 11, further comprising the step of loading the damaged section of the rod string into one of the channels for removal from a well site.

* * * * *